US008590462B1

(12) United States Patent
Dyson

(10) Patent No.: US 8,590,462 B1
(45) Date of Patent: Nov. 26, 2013

(54) TABLE WITH INTEGRATED AND GROUND-COVERING BLANKET

(76) Inventor: Latyrain Dyson, Arlington, TX (US)

( * ) Notice: Subject to any disclaimer, the term of this patent is extended or adjusted under 35 U.S.C. 154(b) by 156 days.

(21) Appl. No.: 13/275,388

(22) Filed: Oct. 18, 2011

(51) Int. Cl.
*A47B 13/08* (2006.01)

(52) U.S. Cl.
USPC ..... 108/90; 108/25; 108/169; 108/174

(58) Field of Classification Search
USPC ..... 108/90, 25, 169, 174; 150/158; 160/330
See application file for complete search history.

(56) References Cited

U.S. PATENT DOCUMENTS 1,684,173 A * 9/1928 Diamond ..... 108/90
1,951,594 A * 3/1934 Carroll ..... 108/130
2,683,639 A * 7/1954 Brenny ..... 108/132
2,837,394 A * 6/1958 Rahall ..... 108/25
2,986,438 A * 5/1961 Smathers et al. ..... 108/116
3,012,919 A * 12/1961 Janney, Jr. ..... 52/273
3,279,515 A 10/1966 Kesh
3,368,601 A * 2/1968 Gantert-Merz ..... 108/90
3,594,177 A * 7/1971 McGowan ..... 426/112
4,143,601 A * 3/1979 Pike ..... 108/35
4,177,737 A * 12/1979 Brickman ..... 108/11
4,337,812 A 7/1982 Trinkner
4,627,363 A 12/1986 Jones
4,705,084 A 11/1987 Rodebaugh
4,708,183 A 11/1987 Figueroa
4,750,402 A * 6/1988 Markey ..... 84/453
4,777,992 A * 10/1988 Olger ..... 108/90
4,872,410 A * 10/1989 Lilly ..... 108/26
4,883,001 A 11/1989 Roth
5,084,321 A 1/1992 Sui
D338,364 S 8/1993 Holzrichter
5,240,758 A * 8/1993 Honigberg ..... 428/100
5,287,614 A * 2/1994 Ehrlich ..... 29/450
5,506,019 A * 4/1996 Abeyta et al. ..... 428/57
5,535,682 A * 7/1996 Aigeldinger ..... 108/25
5,765,487 A * 6/1998 Neff ..... 108/34
5,778,802 A * 7/1998 Hairston et al. ..... 108/90
5,992,331 A * 11/1999 Inoue et al. ..... 108/44
6,170,405 B1 * 1/2001 Weitzman et al. ..... 108/25
6,381,812 B1 5/2002 Crider et al.
6,745,702 B2 * 6/2004 Goldberg et al. ..... 108/26
6,808,071 B2 * 10/2004 Brown ..... 206/525
6,986,928 B2 * 1/2006 Almansa Perea ..... 428/99
6,997,111 B2 * 2/2006 Giegerich ..... 108/25
7,178,470 B2 * 2/2007 Edinger et al. ..... 108/90
8,176,862 B2 * 5/2012 Birdwell ..... 112/475.08
2002/0096092 A1 * 7/2002 Simonson ..... 108/129
2005/0274298 A1 * 12/2005 Paulin ..... 108/90
2006/0230990 A1 * 10/2006 Buckner ..... 108/90
2007/0056482 A1 * 3/2007 Robinson et al. ..... 108/25
2009/0223418 A1 * 9/2009 Ferrara ..... 108/14
2010/0089294 A1 * 4/2010 Medina ..... 108/25

* cited by examiner

*Primary Examiner* — Hanh V Tran
(74) *Attorney, Agent, or Firm* — Kyle Fletcher

(57) ABSTRACT

The table with integrated and ground-covering blanket includes a foldable table from which a cover extends from a bottom, perimeter of a tabletop surface and which covers the surrounding ground. The foldable table includes attaching indicia at the bottom, perimeter that enable attachment of the blanket thereto, as well as to fold and secure shut the table when not in use. The foldable table may include at least one cup holder, and legs that rotate downwardly from underneath.

16 Claims, 4 Drawing Sheets

TABLE WITH INTEGRATED AND GROUND-COVERING BLANKET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of outdoor picnic-styled tables, more specifically, a table that is centrally located and extends up from a blanket integrated there under.

Small tables and foldable card tables have been around for quite some time. These types of tables have a plurality of uses, which range from outdoors to indoors; from adult use to use by children. These tables can sometimes include legs that fold down from underneath in order to support said tables.

What is needed is an improved foldable table that can help keep the surrounding area clean. In the past, one could lay down a blanket or tarp upon the ground, and thereafter place a foldable table thereon. What is more needed is a foldable table wherein a blanket or tarp attaches along a bottom, perimeter and extends down and outwardly to cover the ground in the immediate vicinity of said table. The device of the present application seeks to address this need.

B. Discussion of the Prior Art

As will be discussed immediately below, no prior art discloses a folding table in which a blanket extends from below and upon the ground surrounding said table, and upon which individuals may sit upon said blanket; wherein the table and blanket attach to one another via attaching means located along a bottom, perimeter of said table, and in which said attaching means comprises of a zipper; wherein the table includes legs that can rotate downwardly to elevate and support said table above a ground surface; wherein said table features at least one cup holder thereon; and where upon removal of said blanket, the table can be folded along a middle line and secured via the attaching means.

The Rodebaugh et al. Patent (U.S. Pat. No. 4,705,084) discloses a cover for an outdoor table and benches. However, the cover is not a ground-covering cover that attaches to a bottom, perimeter of said table and which descends down and expands across the ground surrounding said table.

The Crider et al. Patent (U.S. Pat. No. 6,381,812) discloses a device and method for securing a tablecloth to a picnic table. Again, the device and method are directed to covering a picnic table or chaise-styled lounge, and not a cover that extends away from said table and which covers the surrounding ground.

The Patent (U.S. Pat. No. 4,883,001) discloses a picnic table cover.

The Roth Patent (U.S. Pat. No. 5,084,321) discloses a disposable tablecloth for a table that is attached by hook and loop type fastening tape. Again, the disposable tablecloth is directed to covering the tabletop surface of a table, and not to extending from the bottom, perimeter of the tabletop surface in order to cover the surrounding ground.

The Figueroa Patent (U.S. Pat. No. 4,708,183) discloses a combination table cover and skirt retainer. However, the skirt retainer does not extend a cover down and away from a tabletop surface, and provide coverage over the surrounding ground.

The Jones Patent (U.S. Pat. No. 4,627,363) discloses a table covering apparatus. Again, the table covering apparatus is directed to covering the tabletop surface of a table, and not to extending from the bottom, perimeter of the tabletop surface in order to cover the surrounding ground.

The Holzrichter Patent (U.S. Pat. No. Des. 338,364) illustrates an ornamental design for a patio tablecloth, which extends to and only covers the tabletop surface.

The Trinkner Patent (U.S. Pat. No. 4,337,812) discloses a combined picnic bag and tablecloth. Again, the tablecloth is directed to covering the tabletop surface of a table and providing a means of storing items associated with a picnic when not in use, and not a cover extending from the bottom, perimeter of the tabletop surface in order to cover the surrounding ground.

The Kesh et al. Patent (U.S. Pat. No. 3,279,515) discloses a table cover for outdoor use. Again, the table cover is directed to covering the tabletop surface of a picnic table, and not to extending from the bottom, perimeter of the tabletop surface in order to cover the surrounding ground.

While the above-described devices fulfill their respective and particular objects and requirements, they do not describe a folding table in which a blanket extends from below and upon the ground surrounding said table, and upon which individuals may sit upon said blanket; wherein the table and blanket attach to one another via attaching means located along a bottom, perimeter of said table, and in which said attaching means comprises of a zipper; wherein the table includes legs that can rotate downwardly to elevate and support said table above a ground surface; wherein said table features at least one cup holder thereon; and where upon removal of said blanket, the table can be folded along a middle line and secured via the attaching means. In this regard, the table with integrated and ground-covering blanket departs from the conventional concepts and designs of the prior art.

SUMMARY OF THE INVENTION

The table with integrated and ground-covering blanket includes a foldable table from which a cover extends from a bottom, perimeter of a tabletop surface and which covers the surrounding ground. The foldable table includes attaching means at the bottom, perimeter that enable attachment of the blanket thereto, as well as to fold and secure shut the table when not in use. The foldable table may include at least one cup holder, and legs that rotate downwardly from underneath.

An object of the invention is to provide a foldable table from which a ground-covering cover attaches along a bottom, perimeter of a tabletop surface of said table, and which covers the ground surrounding table.

A further object of the invention is to provide a foldable table that includes attaching means at the bottom, perimeter in order to either attach the ground-covering cover or to fold and secure closed the table between uses.

An even further object of the invention is to provide the attaching means such that the table can fold up when not in use, and in which the ground-covering cover may be placed within the table for storage.

A further object of the invention is to provide a foldable table that features a plurality of legs that can rotate downwardly from underneath the tabletop surface in order to elevate the table off of the ground.

A further object of the invention is to provide a foldable table that includes at least one cup holder in the tabletop surface.

An even further object of the invention is to provide a foldable table that includes a tabletop composed of two sections hingedly attached, which enables the tabletop to fold closed when not in use.

These together with additional objects, features and advantages of the table with integrated and ground covering blanket will be readily apparent to those of ordinary skill in the art upon reading the following detailed description of presently preferred, but nonetheless illustrative, embodiments of the table with integrated and ground covering blanket when taken in conjunction with the accompanying drawings.

In this respect, before explaining the current embodiments of the table with integrated and ground covering blanket in detail, it is to be understood that the table with integrated and ground covering blanket is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the table with integrated and ground covering blanket.

It is therefore important that the claims be regarded as including such equivalent construction insofar as they do not depart from the spirit and scope of the table with integrated and ground covering blanket. It is also to be understood that the phraseology and terminology employed herein are for purposes of description and should not be regarded as limiting.

BRIEF-DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 1 illustrates a perspective view of the table with integrated and ground covering blanket set up in which the ground-covering blanket is attached to the bottom, perimeter of the tabletop and extends an undefined area there from;

DETAILED DESCRIPTION OF THE EMBODIMENT

Figure 1:
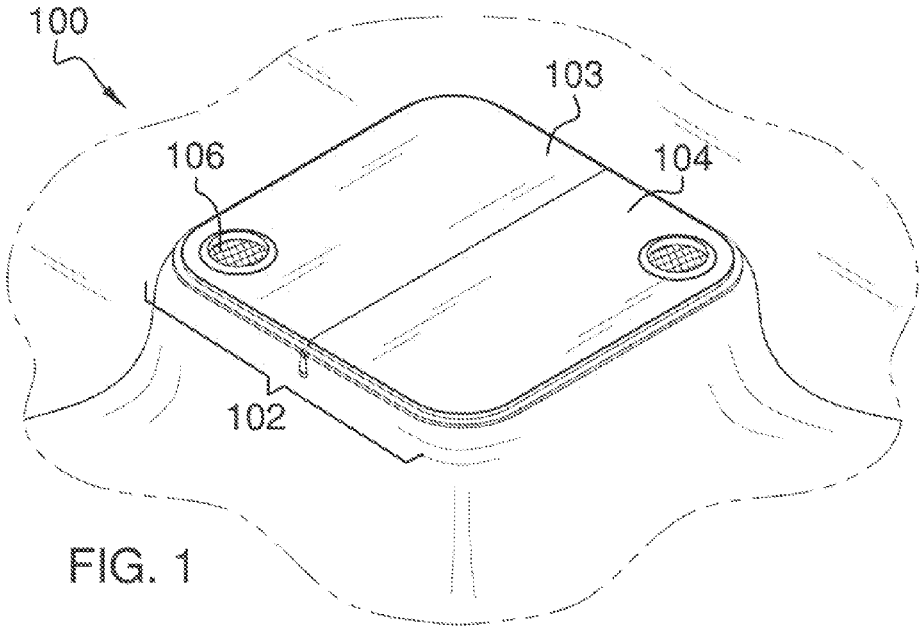

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A table with integrated and ground covering blanket 100 (hereinafter invention) includes a foldable table 101 that is further defined as a tabletop 102 that is composed of a first section 103, and a second section 104. The first section 103 is attached to the second section 104 via a hinge 105 that spans across the middle of the tabletop 102.

Either the first section 103 or the second section 104 may include a cup holder 106 integrated into the surface of the respective section of the tabletop 102. The cup holder 106 is simply constructed of a circular opening from which a cylindrical net 106A extends beneath in order to support a beverage container 130 therein.

The tabletop 102 composed of the first section 103 and the second section 104 shall be made of a material comprising a plastic, metal, wood, or carbon fiber composite. Attached along a bottom surface 102A of the tabletop 102 is a plurality of foldable legs 107.

The foldable legs 107 may be constructed of a bent piece of wire 107A that includes distal ends 107B, which each engages a bracket 107C secured to the bottom surface 102A of the tabletop 102. The foldable legs 107 can rotate from a retracted position (see in FIG. 4) downwardly in order to support the table 101 at an elevation 108 above the ground 140.

It shall be important to distinguish the term foldable table 101 from the tabletop 102. The foldable table 101 includes the tabletop 102 as well as the foldable legs 107. The tabletop 102 is only composed of the first section 103, the second section 104, and the hinge 105 connected there between.

The tabletop 102 is further defined with a bottom, perimeter 102B that extends from both the first section 103 and the second section 104. Extending along the bottom, perimeter 102B of the tabletop 102 is attaching means 108. The attaching means 108 are included in order to perform two functions of the invention 100, which are (1) to attach a ground-covering cover 110 (see FIG. 4), and (2) to secure the table 101 in a folded state (see FIG. 2).

The ground-covering cover 110 is unique to the invention 100 in that the ground-covering cover 110 extends from the table 101 and covers the ground 140 surrounding the table 101. It shall be noted that the ground-covering cover 110 does not cover the area of the ground 140 directly underneath the table 101. Moreover, the ground-covering cover 110 includes an opening 110A that mirrors the shape of the bottom, perimeter 102B of the tabletop 102. The opening 110A includes attaching means 108 thereon so as to marry with the attaching means 108 located on the bottom, perimeter 102B of the tabletop 102.

Figure 2:
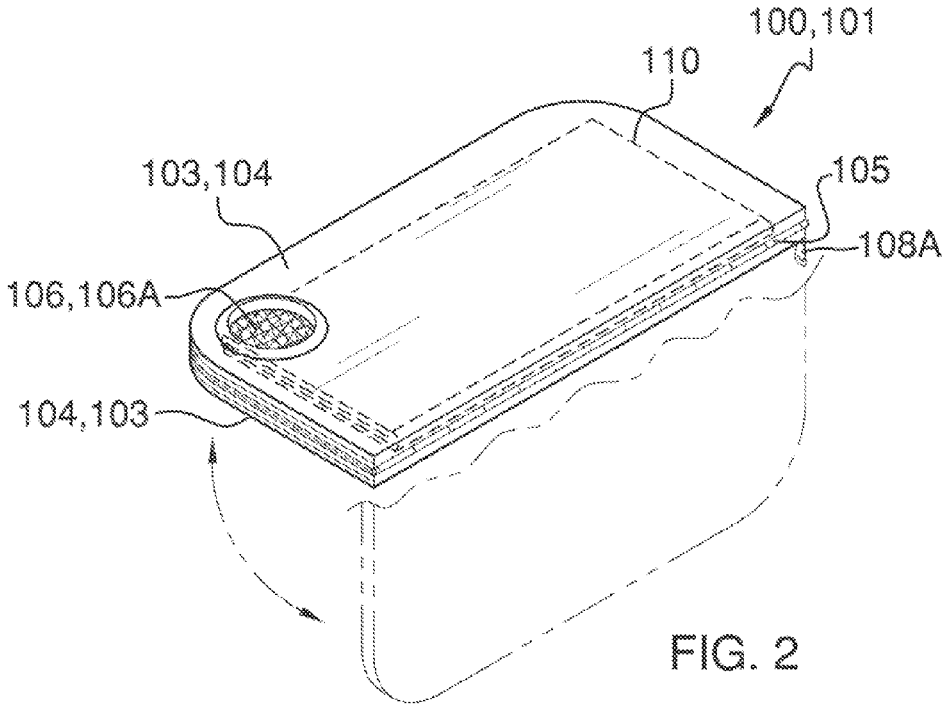
FIG. 2 illustrates a perspective view of the hingedly attached sections of the tabletop in which the sections are folded flat and against one another and including an arrow depicting rotational movement of the hinge.
Figure 3:
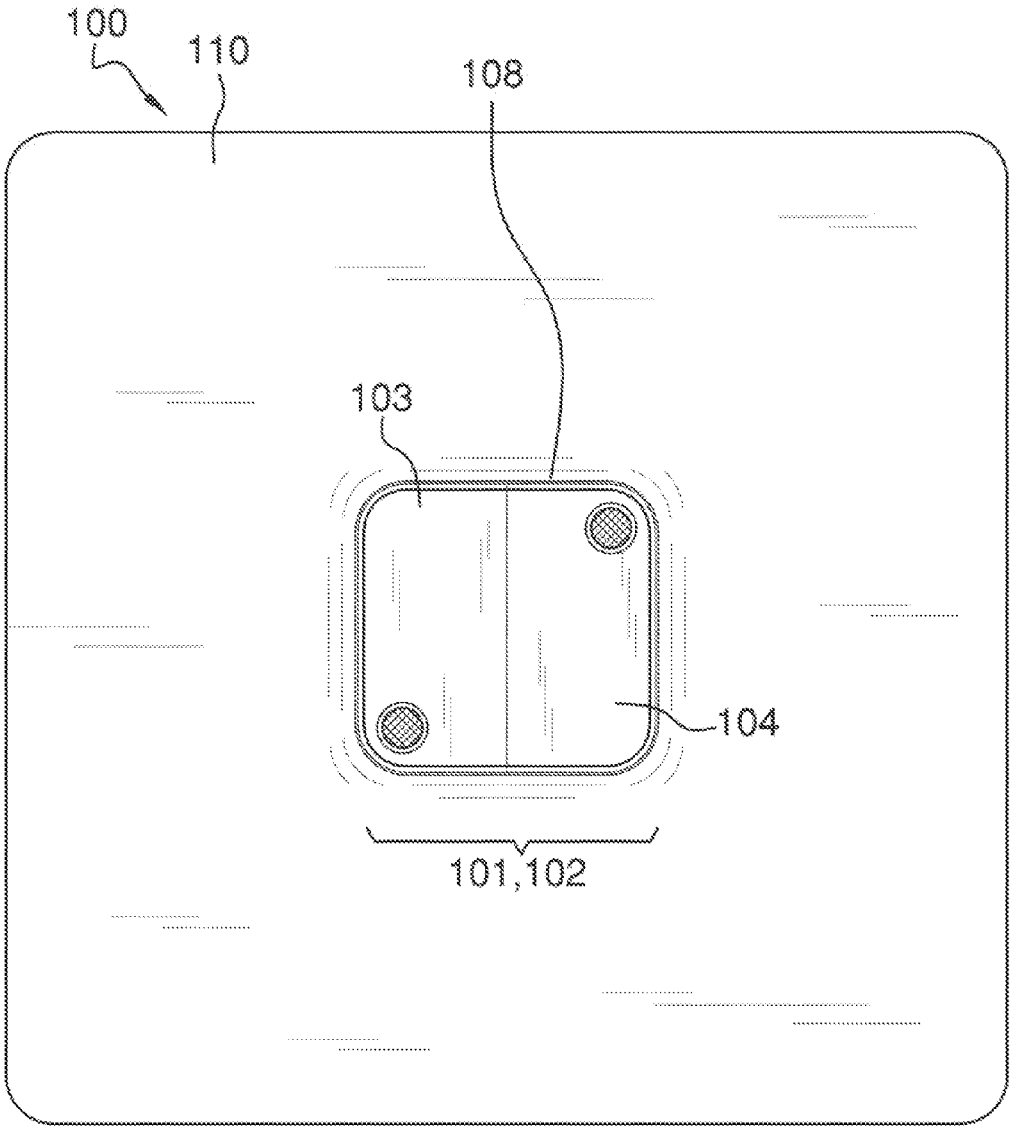
FIG. 3 illustrates a top view of the tabletop and ground-covering blanket extending therefrom.
Figure 4:
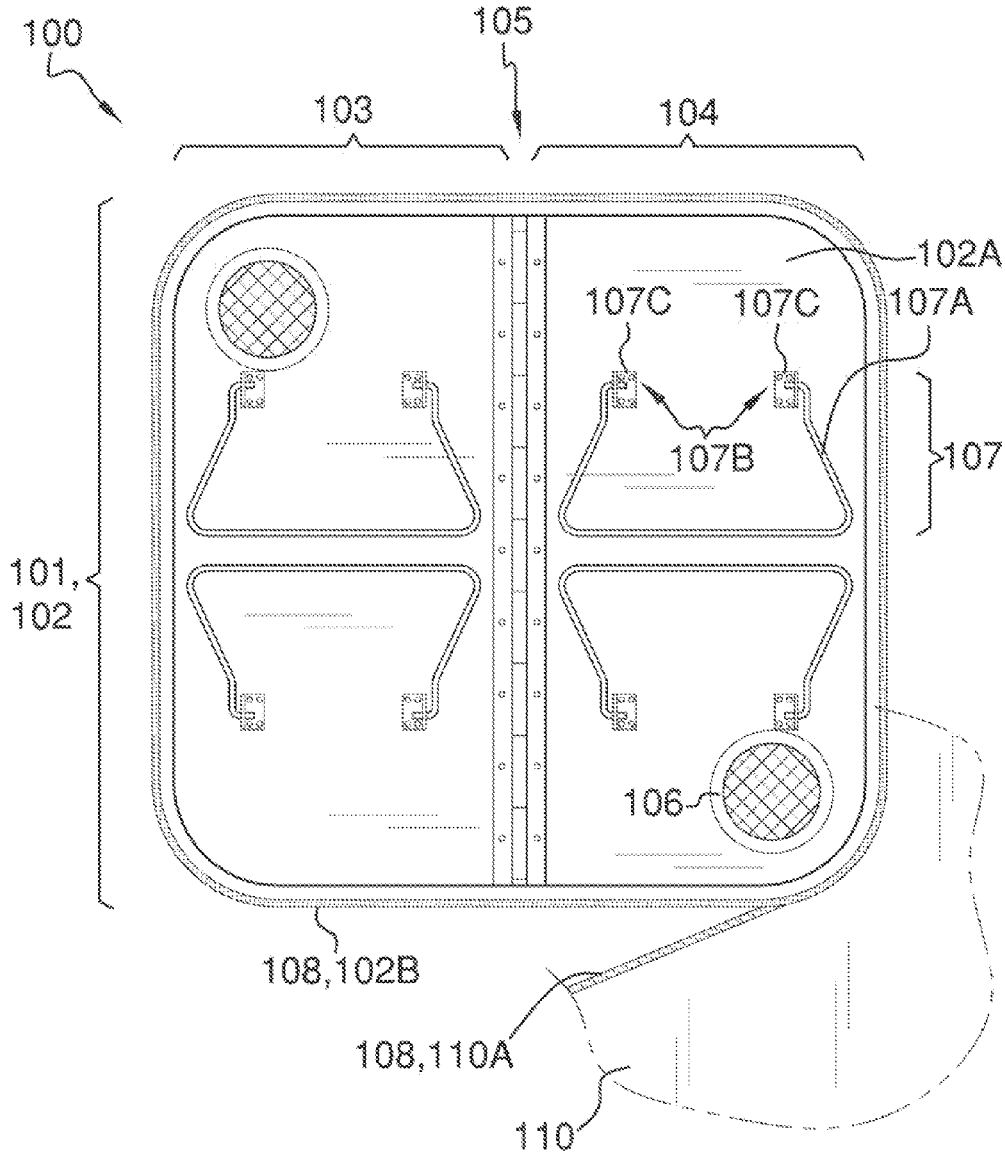
FIG. 4 illustrates a bottom view and detail of the attaching means used to secure the ground-covering blanket to the bottom, perimeter of the tabletop while also detailing the construction of the cup-holders and foldable legs provided underneath the tabletop.
Figure 5:
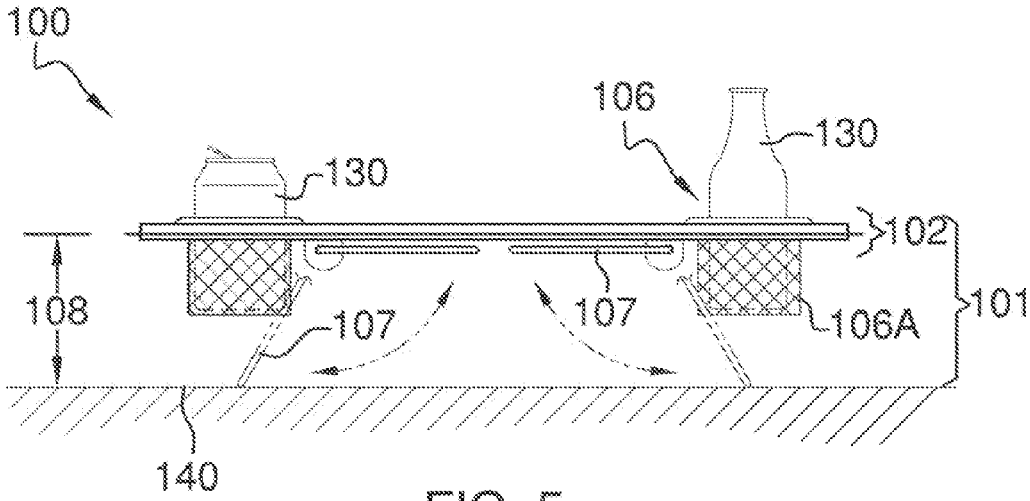
FIG. 5 illustrates a side profile of the foldable legs extending from underneath the tabletop and rotating downwardly for use in elevating the tabletop surface off of the ground when in use.
Figure 6:
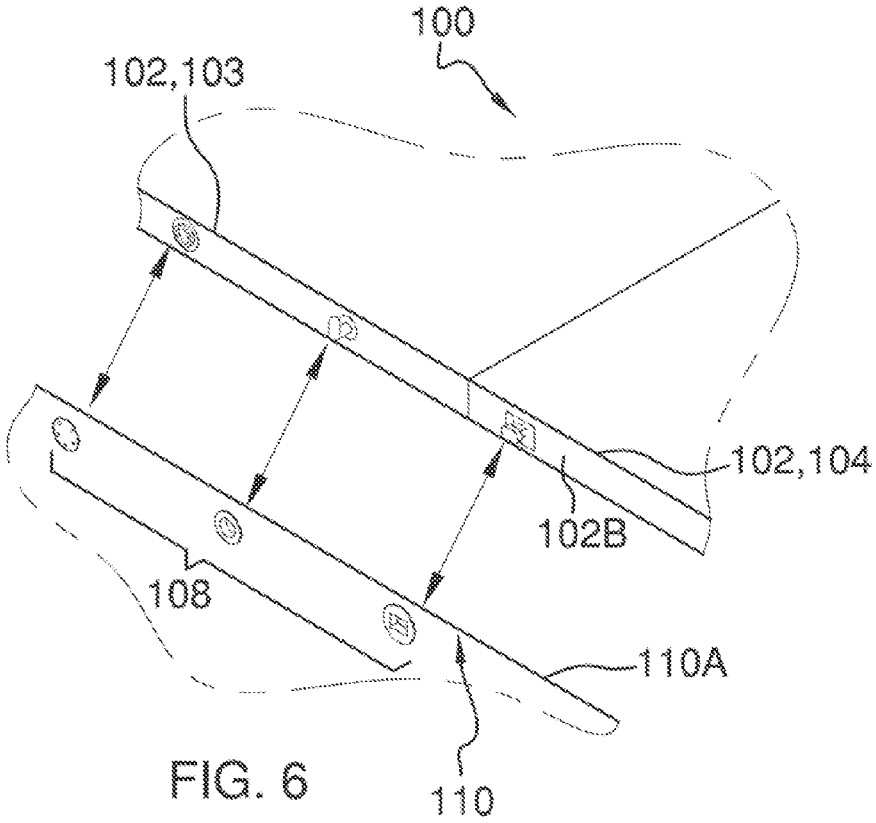
FIG. 6 illustrates a cut-away view of the varying types of attaching means that may be used to secure the ground-covering cover to the foldable table.

It shall be hereby noted that the ground-covering cover 110 may be folded up when not attached to the table 101, and stored inside of the table 101 when not in use (see FIG. 2).

The ground-covering cover 110 shall be made of a flexible material, and may be a tarp or fabric. The ground-covering cover 110 shall have an undefined shape and size, and may cover a relatively small or large area of ground 140 when compared to the table 101.

It shall be noted that the attaching means 108 are ideally zipper teeth. However, it shall be noted that the attaching means 108 may include hook and grommets, twist stud, or button snaps (see FIG. 6).

Provided the attaching means 108 involves a zipper, then a zipper pull 108A is required to attach the ground-covering cover 110 to the table 101. However, it shall be noted that the zipper pull 108A shall also be required to close off the table 101 between use (see FIG. 2).

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A table with integrated and ground-covering cover comprising:

a foldable table from which a ground-covering cover attaches along a bottom, perimeter;

wherein the foldable table comprises a tabletop and support legs, the support legs support the tabletop at an elevated position above a ground surface; said ground-covering cover extends down and away from said foldable table in order to cover ground surface surrounding said foldable table perimeter, and upon which individuals may sit thereon.

2. The table with integrated and ground-covering cover as described in claim 1 wherein the support legs comprise foldable legs that are rotatably engaged with respect to a bottom surface of the tabletop.

3. The table with integrated and ground-covering cover as described in claim 2 wherein the tabletop is further defined as a first section attached to and rotatably engaged with respect to a second section via a hinge.

4. The table with integrated and ground-covering cover as described in claim 3 wherein the hinge spans across the middle of the tabletop formed of the first section and the second section.

5. The table with integrated and ground-covering cover as described in claim 2 wherein the tabletop includes at least one cup holder therein; wherein the cup holder is constructed of a circular hole from which a cylindrically-shaped net attaches there from and which supports a beverage container therein.

6. The table with integrated and ground-covering cover as described in claim 2 wherein the plurality of foldable legs are each constructed of a bent piece of wire that includes distal ends, which each engages a bracket secured to the bottom surface of the tabletop.

7. The table with integrated and ground-covering cover as described in claim 6 wherein the foldable legs can rotate from a retracted position downwardly in order to support the table at an elevation above the ground.

8. The table with integrated and ground-covering cover as described in claim 3 wherein attaching means adorn the bottom, perimeter of the tabletop and to which the ground-covering cover attaches thereto.

9. The table with integrated and ground-covering cover as described in claim 8 wherein the attaching means comprises a zipper, button snaps, twist studs, or hook and grommets.

10. The table with integrated and ground-covering cover as described in claim 8 wherein the attaching means are further used to close the tabletop when not in use.

11. The table with integrated and ground-covering cover as described in claim 10 wherein the ground-covering cover is folded and inserted in between the first section and the second section when closing the tabletop; wherein the attaching means is used to secure the tabletop closed when not in use.

12. The table with integrated and ground-covering cover as described in claim 11 wherein the cover includes an opening that mirrors the shape of the bottom, perimeter of the tabletop; wherein the opening includes attaching means thereon so as to marry with the attaching means located on the bottom, perimeter of the tabletop.

13. A table with integrated and ground-covering cover comprising:

a foldable table from which a ground-covering cover attaches along a bottom, perimeter;

wherein said ground-covering cover extends down and away from said foldable table in order to cover ground surrounding said foldable table;

wherein the ground-covering cover extends and covers an undefined area of ground surrounding said foldable table perimeter, and upon which individuals may sit thereon;

wherein the foldable table is further comprised of a tabletop and foldable legs that are rotatably engaged with respect to a bottom surface of the tabletop;

wherein the tabletop is further defined as a first section attached to and rotatably engaged with respect to a second section via a hinge;

wherein the hinge spans across the middle of the tabletop formed of the first section and the second section;

wherein the tabletop includes at least one cup holder therein; wherein the cup holder is constructed of a circular hole from which a cylindrically-shaped net attaches there from and which supports a beverage container therein;

wherein the plurality of foldable legs are each constructed of a bent piece of wire that includes distal ends, which each engages a bracket secured to the bottom surface of the tabletop;

wherein the foldable legs can rotate from a retracted position downwardly in order to support the table at an elevation above the ground.

14. The table with integrated and ground-covering cover as described in claim 13 wherein attaching means adorn the bottom, perimeter of the tabletop and to which the ground-covering cover attaches thereto; wherein the attaching means are further used to close the tabletop when not in use.

15. The table with integrated and ground-covering cover as described in claim 14 wherein the attaching means comprises a zipper, button snaps, twist studs, or hook and grommets.

16. The table with integrated and ground-covering cover as described in claim 14 wherein the ground-covering cover is folded and inserted in between the first section and the second section when closing the tabletop; wherein the attaching means is used to secure the tabletop closed when not in use; wherein the cover includes an opening that mirrors the shape of the bottom, perimeter of the tabletop; wherein the opening includes attaching means thereon so as to marry with the attaching means located on the bottom, perimeter of the tabletop.

* * * * *